US010724312B2

(12) United States Patent
Zsolt

(10) Patent No.: US 10,724,312 B2
(45) Date of Patent: Jul. 28, 2020

(54) COILED TUBING BOTTOM HOLE ASSEMBLY DEPLOYMENT

(71) Applicant: SCHLUMBERGER TECHNOLOGY CORPORATION, Sugar Land, TX (US)

(72) Inventor: Liam Thomas Fairburn Zsolt, Anchorage, AK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 191 days.

(21) Appl. No.: 15/762,259

(22) PCT Filed: Sep. 22, 2016

(86) PCT No.: PCT/US2016/052987

§ 371 (c)(1),
(2) Date: Mar. 22, 2018

(87) PCT Pub. No.: WO2017/053498

PCT Pub. Date: Mar. 30, 2017

(65) Prior Publication Data

US 2018/0274311 A1 Sep. 27, 2018

Related U.S. Application Data

(60) Provisional application No. 62/222,043, filed on Sep. 22, 2015.

(51) Int. Cl.
*E21B 19/22* (2006.01)
*E21B 41/00* (2006.01)
(Continued)

(52) U.S. Cl.
CPC ..... *E21B 19/22* (2013.01); *E21B 19/08* (2013.01); *E21B 19/161* (2013.01); *E21B 33/062* (2013.01); *E21B 41/00* (2013.01)

(58) Field of Classification Search
CPC ..... E21B 19/22; E21B 19/08; E21B 19/161; E21B 33/062; E21B 41/00; E21B 33/03;
(Continued)

(56) References Cited

U.S. PATENT DOCUMENTS 5,439,066 A * 8/1995 Gipson ..... E21B 7/04
6,158,516 A 12/2000 Smith et al.
(Continued)

OTHER PUBLICATIONS

International Search Report and Written Opinion issued in International Patent Appl. No. PCT/US2016/052987 dated Jan. 5, 2017; 24 pages.

*Primary Examiner* — Yong-Suk Ro
(74) *Attorney, Agent, or Firm* — Cathy Hewitt

(57) ABSTRACT

Apparatus and methods are provided for assembling and positioning a bottom hole assembly (BHA) or tool string within a wellbore. The tool string is run via coiled tubing. The apparatus includes a deployment unit operable at a wellsite to make up and run the downhole tool string into the wellbore. In an example, the deployment unit includes a reel of the coiled tubing, a snubbing unit operable to run downhole tools into the wellbore, an injector head operable to run the coiled tubing with the tool string connected with the coiled tubing, and a support structure operable to support the snubbing unit and the injector head above the wellbore.

21 Claims, 7 Drawing Sheets

(51) Int. Cl.

| | |
|---|---|
| ***E21B 19/08*** | (2006.01) |
| ***E21B 19/16*** | (2006.01) |
| ***E21B 33/06*** | (2006.01) |

(58) Field of Classification Search
CPC ..... E21B 33/068; E21B 7/02; E21B 33/072; E21B 15/00
See application file for complete search history.

(56) References Cited

U.S. PATENT DOCUMENTS

| | | | | |
|---|---|---|---|---|
| 6,530,432 | B2 * | 3/2003 | Gipson | E21B 19/22 |
| 6,973,979 | B2 * | 12/2005 | Carriere et al. | E21B 3/06 |
| 7,926,576 | B2 | 4/2011 | Rock et al. | |
| 8,820,410 | B2 | 9/2014 | Parks et al. | |
| 2006/0283587 | A1 * | 12/2006 | Wood et al. | E21B 19/22 |
| 2007/0295497 | A1 | 12/2007 | Pleskie et al. | |
| 2014/0209299 | A1 | 7/2014 | Shah | |

* cited by examiner

COILED TUBING BOTTOM HOLE ASSEMBLY DEPLOYMENT

CROSS-REFERENCE TO RELATED APPLICATIONS

This application claims priority to and the benefit of U.S. Provisional Application No. 62/222,043, titled "Coiled Tubing BHA Hydraulic Deployment Unit," filed Sep. 22, 2015, the entire disclosure of which is hereby incorporated herein by reference.

BACKGROUND OF THE DISCLOSURE

Wells are generally drilled into a land surface or ocean bed to recover natural deposits of oil and gas, as well as other natural resources that are trapped in geological formations in the Earth's crust. Wellbores may be drilled along a trajectory to reach one or more subterranean rock formations containing such natural resources.

Coiled tubing technology may be utilized to reach the oil and gas deposits and to perform various wellbore intervention operations. The ability of coiled tubing to pass through completion tubulars and to utilize a wide array of tools and technologies in conjunction with the coiled tubing make coiled tubing a versatile technology. A typical coiled tubing apparatus includes surface pumping facilities, a coiled tubing string mounted on a reel, a method to convey the coiled tubing into and out of the wellbore (such as an injector head or the like), and surface control apparatus at a wellhead. Coiled tubing may be utilized for performing well treatment and/or well intervention operations in existing wellbores, such as, but not limited to, hydraulic fracturing, matrix acidizing, patching, milling, drilling, perforating, and the like.

In working with deeper and more complex wellbores, it becomes more likely that downhole tools, tool strings, bottom hole assemblies, and/or other downhole apparatus may include numerous testing, measurement, navigation, communication, and other downhole tools, resulting in increasingly longer tool strings. The length of downhole tools is often dependent on what function they perform, where additional functions typically imply additional length. As more and more sophisticated functions are performed downhole, tools have grown in length to the point where deploying them into a wellbore has become a significant challenge in face of maintaining well control.

In coiled tubing operations, downhole tools may be deployed into a wellbore via an injector head. To perform such operations, an assembled tool string may be pulled into a riser and positioned over the wellbore. The riser may then be attached to a blowout preventer (BOP) and utilized to seal off the wellbore while the tool string to be deployed into the wellbore. Using such method limits the overall length of the assembled tool string, as the length of the riser is limited by the height of a structure supporting the riser on top of the BOP.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus that includes a deployment unit operable at a wellsite to make up and run a downhole tool string into a wellbore. The deployment unit includes a reel of the coiled tubing, a snubbing unit to run downhole tools to form the tool string, an injector head to run the coiled tubing with the tool string connected with the coiled tubing, and a support structure to support the snubbing unit and the injector head above the wellbore.

The present disclosure also introduces an apparatus that includes a snubbing unit to be supported above a wellbore by a vertical structure of a coiled tubing unit. The snubbing unit is operable to run downhole tools to assemble a tool string. The snubbing unit includes a hydraulic jack, stationary slips, and traveling slips. The apparatus also includes an annular preventer and a blowout preventer stack.

The present disclosure also introduces a method that includes assembling a downhole tool string by making up downhole tools and running the made up downhole tools into a wellbore with a snubbing unit. The method also includes connecting the downhole tool string with coiled tubing and running the coiled tubing with the connected downhole tool string with an injector head.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
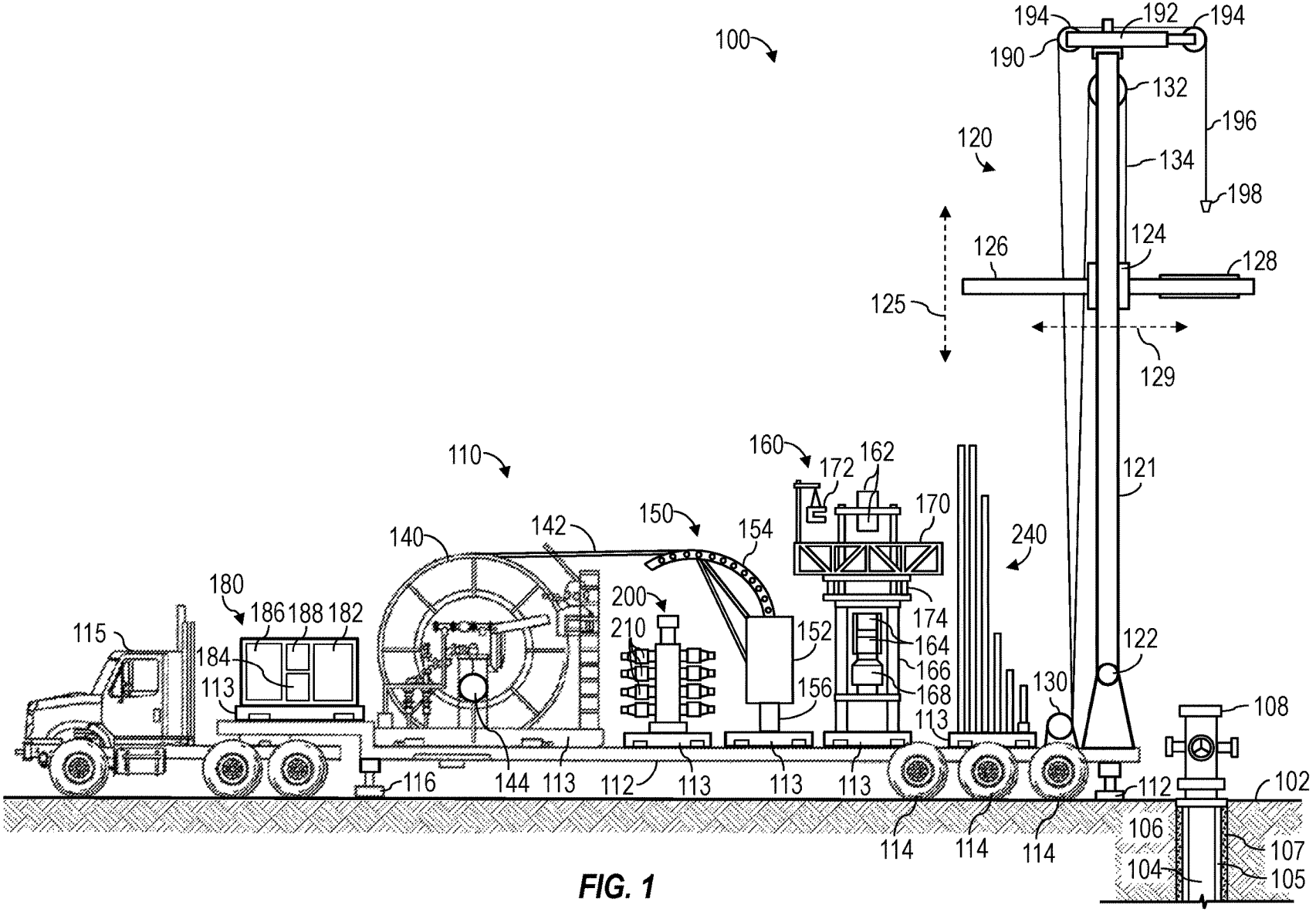
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed.

As introduced herein, a deployment unit within the scope of the present disclosure may be operable at a wellsite to make up and run a downhole tool string into a wellbore via coiled tubing. The deployment unit may comprise a reel of the coiled tubing, a snubbing unit operable to run downhole tools into the wellbore, an injector head operable to run the coiled tubing with the tool string connected with the coiled tubing into the wellbore, and a support structure operable to support the snubbing unit and the injector head above the wellbore.

FIG. 1 is a schematic view of at least a portion of an example implementation of an oil and gas wellsite system 100 showing at least a portion of an example environment utilized in conjunction with a coiled tubing deployment unit 110 according to one or more aspects of the present disclosure. The figure depicts a wellsite surface 102 adjacent to a wellbore 104 and a partial sectional view of a subterranean formation 106 penetrated by the wellbore 104 below the wellsite surface 102. At least a portion of the wellbore 104 may comprise a casing 105 secured within the wellbore 104 by a cement sheath 107. However, one or more aspects of the present disclosure are also applicable to open-hole implementations, in which the cement sheath 107 and the casing 105 have not yet been installed in the wellbore 104. The wellbore 104 may terminate with a wellhead 108 at the wellsite surface 102.

In an example implementation, the deployment unit 110 may comprise a support platform 112, such as a transportable trailer supported by a plurality of wheels 114. The platform 112 may be operable to engage and be transported by a motorized vehicle 115, such as a truck, to form a truck-trailer operable to be transported to and from the wellsite surface 102. When implemented as the truck trailer, the platform 112 may be road legal, permitting transport of various wellsite equipment over public highway systems. However, the platform 112 may be skidded or otherwise stationary, and/or may be temporarily or permanently installed at the wellsite surface 102. The platform 112 may comprise stabilizing equipment, such as a plurality of stabilizer legs 116 that may be selectively pressed against the wellsite surface 102 to both level and stabilize the platform 112 during deployment operations described below.

The deployment unit 110 may also comprise a vertical support assembly, such as a mast assembly 120, mounted to the platform 112 and operable to support various components of the deployment unit 110 as well as various downhole tools above the wellbore 104. The mast assembly 120 may comprise an elongated support structure, such as a mast 121, pivotably mounted to the platform 112 via a pivot member 122, which may be permit the mast assembly 120 to be pivoted between a lowered or transport position and a raised or operating position. A hydraulic cylinder (not shown) may be utilized to move the mast assembly 120 between the lowered and raised positions.

The mast assembly 120 may comprise a trolley or carriage 124 slidably or otherwise movably connected with the mast 121, such as may permit the carriage 124 to move along the length of the mast 121, as indicated by arrows 125. The carriage 124 may comprise or carry a support structure 126 extending substantially perpendicularly to and on opposing sides of the mast 121. The mast assembly 120 may further comprise a trolley or carriage 128 slidably or otherwise movably connected with the support structure 126, such as may permit the carriage 128 to move along the support structure 126 between the opposing sides of the mast 121, as indicated by arrows 129. One or both of the carriages 124, 128 may be or comprise a bracket, a mounting plate, a frame, or another member operable to connect with and support deployment devices, such as an injector head unit 150, a snubbing unit 160, and/or other devices operable to run and retrieve coiled tubing, downhole tools, and/or downhole tubulars into and out of the wellbore 104. The carriage 124 and thus, the support structure 126 and the carriage 128, may be moved along the length of the mast 121 by a winch system, a drawworks, a rack and pinion system, hydraulic cylinders or motors, or other means. A winch system utilized to move the carriage 124 may include a winch unit 130, one or more pulleys 132, and a cable 134 extending from the winch unit 130 to the carriage 124. During operations, the winch unit 130 may wind or unwind the cable 134 to move the carriage 124 upwards and downwards along the mast 121, as indicated by the arrows 125. The carriage 128 may be moved along the support structure 126, as indicated by the arrows 129, by a winch system, hydraulic cylinders or motors, a rack and pinion system, or other means (not shown). Accordingly, when the mast assembly 120 is in the raised position, the carriage 124 may cause the deployment device connected to one of the carriages 124, 128 to be moved vertically toward and away from the wellbore 104. If the deployment device is connected to the carriage 128, the carriage 128 may cause the deployment device to be moved horizontally with respect to the wellsite surface 102 to align or position the deployment device above the wellbore 104. Although the deployment unit 110 is shown comprising the support structure 126 and the carriage 128, the deployment unit 110 may be provided without such components, resulting in the deployment devices being connected to and moved solely by the carriage 124. In such setting, horizontal alignment between the deployment device and the wellbore 104 may be adjusted by moving the platform 112.

The deployment unit 110 may comprise a reel 140 of coiled tubing 142 rotatably mounted on the platform 112. During coiled tubing deployment operations, the reel 140 may be selectively rotated to provide the coiled tubing 142 for deployment into the wellbore 104 and to receive the coiled tubing 142 retrieved from the wellbore 104. The reel 140 may be rotated by a motor 144, such as a hydraulic or electric motor, or by other means.

The deployment unit 110 may further comprise a coiled tubing injector head unit 150 having an injector head 152 operable to run and retrieve the coiled tubing 142 into and out of the wellbore 104. A gooseneck 154 may be mounted on top of the injector head 152 to feed or direct the coiled tubing 142 from the reel 140 around a controlled radius into the injector head 152. A stripper assembly 156 may be mounted at the base of the injector head 152. The stripper assembly 156 may be operable to seal against the coiled tubing 142 as it exits or enters the injector head 152 and may be utilized to connect the injector head 152 to various pressure-control equipment, such as a BOP, or other intermediate tools extending between the BOP and the injector head 152.

The injector head unit 150 may be adapted to be selectively mounted to the mast assembly 120 and supported above the wellbore 104, such as may permit the injector head unit 150 to deploy the coiled tubing 142 into the wellbore 104 during deployment operations. During coiled tubing deployment, the injector head 152 may be mounted to one of the carriages 124, 128, such as may facilitate positioning or moving the injector head 152 into alignment with the wellbore 104 and/or to a predetermined height above the wellbore 104. When not in use, such as during transportation, the injector head unit 150 may be stored on the platform 112.

The deployment unit 110 may also comprise or be utilized in conjunction with a plurality of downhole tools 240 operable to be ran into or retrieved from the wellbore 104 during deployment operations. As described below, the deployment unit 100 may be utilized to make up and deploy the downhole tools 240 into the wellbore 104 to assemble at least a portion of a tool string 242 (shown in FIG. 7) within the wellbore 104. The downhole tools 240 may be or comprise components of the tool string 242, such as a drilling bottom hole assembly (BHA), a milling BHA, a patch BHA, among other BHAs and/or tool strings utilized within the wellbore 104. In the case of the drilling BHA, the downhole tools 240 may be or comprise one or more of a motor head assembly (MHA), a non-rotating joint (NRJ) or swivel, an orienting sub, a sensor sub, a mud motor, a directional control sub, and a drill bit. In the case of the milling BHA, the downhole tools 240 may be or comprise one or more of an MHA, an NRJ or swivel, length(s) of heavy drill pipe, a mud motor, and a mill. The patch BHA may be operable to install a permanent patch inside the wellbore 104. Example downhole tools 240 forming the patch BHA may be or comprise an MHA, an MU or swivel, a setting tool, packer(s), length(s) of straight joint(s), a nipple with a plug, and a mule shoe. Although the downhole tools 240 are shown stored on the platform 112, the downhole tools 240 may be stored and/or transported to the wellsite surface 102 separately from and/or by means other than the platform 112.

The deployment unit 110 may also comprise or be utilized in conjunction with a snubbing unit 160 operable to run and retrieve downhole tools 240 and/or tubulars into and out of a live well. The snubbing unit 160 may comprise opposing traveling slips 162 operable to support the weight of the downhole tools 240 or tool string 242 under pipe heavy conditions and snub the downhole tools 240 or tool string 242 under pipe light conditions. The snubbing unit 160 may further comprise opposing stationary slips 164 operable to support the weight of the downhole tools 240 or tool string 242 under pipe heavy conditions and to hold the downhole tool or tool string in position under pipe light conditions. A hydraulic jack 166 may be utilized to raise and lower the traveling slips 162 and the downhole tools 240 or tool string 242 held by the traveling slips 162 to run and retrieve the downhole tools 240 or tool string 242 under the pipe heavy and pipe light conditions. The traveling slips 162 may be connected with rods or moving portion of the hydraulic jack 166, while the stationary slips 164 may be connected with a body or stationary portion of the hydraulic jack 166. An annular BOP 168 may be connected below the stationary slips 164, connecting the stationary slips 164 with the stationary portion of the hydraulic jack 166. When fluidly connected with the wellbore 104, the annular BOP 168 may be operable to control wellbore fluids by sealing on the downhole tools 240 or tool string 242 during deployment and retrieval. The snubbing unit 160 may further comprise a work basket 170, which may house snubbing unit controls and support human operators handling the downhole tools 240 or tool string 242 being run or retrieved via the snubbing unit 160.

The snubbing unit 160 may also comprise or be utilized in conjunction with various torquing equipment 172 operable to make up and break down the downhole tools 240 or tool string 242 being run or retrieved via the snubbing unit 160. The torquing equipment 172 may include wrenches and/or power tongs, which may be contained within or suspended above the work basket 170 for use by the human operators. An intermediate frame 174 may connect or support the work basket 170 above the stationary portion of the hydraulic jack 166.

The snubbing unit 160 may be a scaled down snubbing unit, adapted to be selectively mounted to the mast assembly 120 and supported above the wellbore 104, such as may permit the snubbing unit 160 to deploy the downhole tools 240 or tool string 242 into the wellbore 104 during deployment operations. For example, the snubbing unit 160 may be operable to run and retrieve downhole tools 240 having a diameter or size ranging between about 4.29 centimeters ($1\frac{11}{16}$ inches) and about 9.91 centimeters ($3\frac{9}{10}$ inches). During snubbing operations, the snubbing unit 160 may be mounted to one of the carriages 124, 128, such as may facilitate positioning or moving the snubbing unit 160 into alignment with the wellbore 104 and to a predetermined height above the wellbore 104. When not in use, such as during transportation, the snubbing unit 160 may be stored on the platform 112. Although the snubbing unit is shown stored on the platform 112, the snubbing unit 160 may be stored and/or transported to the wellsite surface 102 separately from and/or by means other than the platform 112.

The deployment unit 110 may further comprise a hydraulic power unit 180 operable provide pressurized hydraulic fluid to operate or power various portions of the deployment unit 110 and/or other devices utilized with or in conjunction with the deployment unit 110. For example, the hydraulic power unit 180 may supply the pressurized hydraulic fluid to one or more of the injector head unit 150, the snubbing unit 160, the torquing device 172, the winch unit 130, the mast lifting cylinders (not shown), the reel rotating motor 144, and other devices. The hydraulic power unit 180 may comprise hydraulic fluid tank 182, a hydraulic pump 184, a prime mover 186, such as an internal combustion engine, and a hydraulic valve stack 188 operable to control the direction and the destination of the hydraulic fluid.

The deployment unit 110 may further comprise a crane, an elevator, or another lift system 190 operable to lift, move, or otherwise handle various portions of the deployment unit 110, downhole tools 240, downhole tubulars, and other tools and/or devices utilized with or in conjunction with the deployment unit 110. In an example implementation, the lift system 190 may be a part of or supported by the mast assembly 120. The lift system 190 may comprise an extendable boom 192 pivotably connected with the mast 121 and a plurality of pulleys 194 connected with the boom 192 and operable to guide a cable 196 wound onto the winch unit 130. The winch unit 130 may comprise multiple independently operated spools, such as may facilitate independent winding and unwinding of the cables 134, 196. The cable 196 may terminate with an elevator, a swivel connector, a standing tubular engaging assembly, or another tool 198 operable to engage or connect with the portions of the deployment unit 110, downhole tools 240, downhole tubulars, the injection head unit 150, the snubbing unit 160, and/or other tools and devices utilized with or in conjunction with the deployment unit 110, such as may permit the lift system 190 to lift and move such tools and devices to an intended location.

The deployment unit 110 may also comprise or be utilized in conjunction with a BOP stack 200 utilized to facilitate wellbore pressure control during deployment operations. The BOP stack 200 may comprise a plurality of ram-type preventers 210 sized for or otherwise tailored to the downhole tools 240 and coiled tubing 142 and operable to provide pressure integrity, safety, and flexibility during deployment operations and/or in the event of a well control incident. The BOP stack 200 may also include various spools, adapters and piping outlets (not shown) to permit circulation of wellbore fluids under pressure during deployment operations and/or in the event of a well control incident. An upper end of the BOP stack 200 may be adapted to be directly or indirectly connected with the snubbing unit 160 and the injection head unit 150, while the lower end of the BOP stack 200 may be adapted to be directly or indirectly mounded to the wellhead 108. Accordingly, during deployment operations, the downhole tools 240 and the coiled tubing 142 may be deployed through the BOP stack 200. When not in use, such as during transportation, the BOP stack 200 may be stored on the platform 112. Although the BOP stack 200 is shown stored on the platform 112, the BOP stack 200 may be stored and/or transported to the wellsite surface 102 separately from and/or by means other than the platform 112.

One or more of the reel 140, the injector head unit 150, the snubbing unit 160, the hydraulic power unit 180, the BOP stack 200, and the downhole tools 240 may be mounted on or supported by a corresponding palette or base 113, which may be utilized to transport each component to, from, or along the platform 112. Although FIG. 1 shows the injector head unit 150, the snubbing unit 160, the BOP stack 200, and the downhole tools 240 disposed on the platform 112 while in a vertical position, it is to be understood that one or more of such components may be disposed on the platform 112 during transport and/or deployment operations while in a horizontal position.

Figure 2:
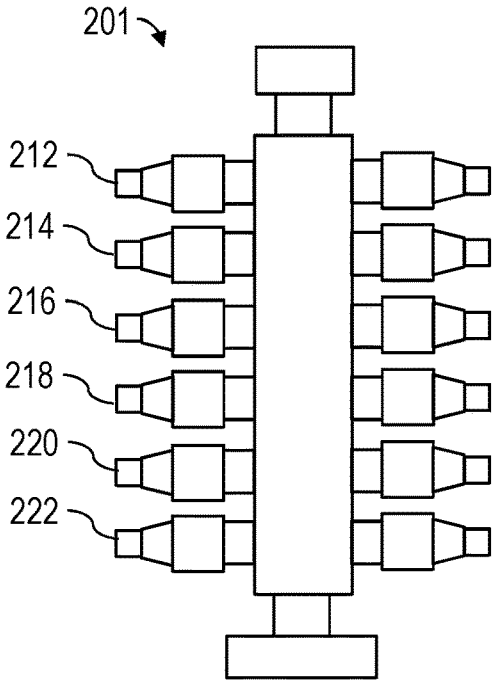
FIG. 2 is a schematic view of at least a portion of an example implementation of apparatus according to one or more aspects of the present disclosure.
Figure 3:
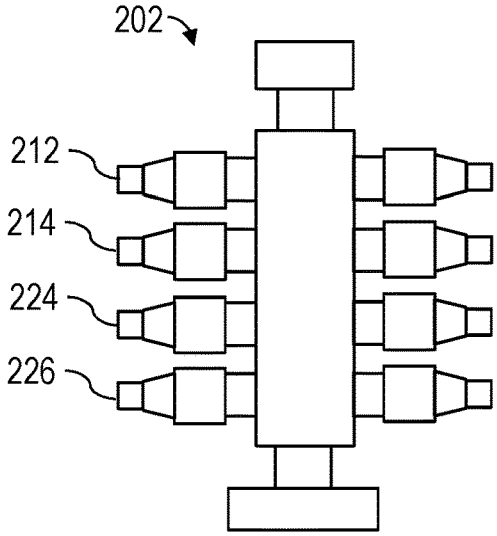
FIG. 3 is a schematic view of at least a portion of an example implementation of apparatus according to one or more aspects of the present disclosure.
Figure 4:
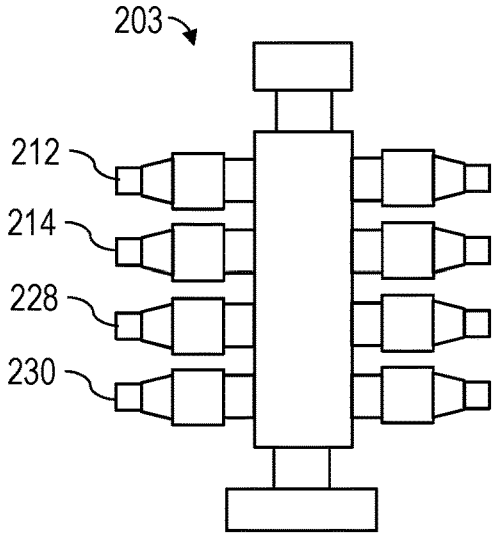
FIG. 4 is a schematic view of at least a portion of an example implementation of apparatus according to one or more aspects of the present disclosure.

FIGS. 2-4 are schematic views of example implementations of the BOP stack 200 shown in FIG. 1 according to one or more aspects of the present disclosure and designated in FIGS. 2-4 by reference numerals 201, 202, 203, respectively. The following description refers to FIGS. 1-4, collectively.

The BOP stack 201 may comprise a set of blind rams 212 operable to close over or seal the wellbore 104 that does not contain the tool string 242 or coiled tubing 142 deployed therein. The BOP stack 201 may further comprise a set of large shear rams 214 operable to close over or seal the wellbore 104 while cutting the tool string 242 and coiled tubing 142 deployed therein. The BOP stack 201 may further comprise slip rams 216 sized or otherwise operable to hold the downhole tools 240 or tool string 242 in position and pipe rams 218 sized or otherwise operable to seal on the downhole tools 240 or tool string 242 being held in position by the slip rams 216. The BOP stack 201 may also comprise slip rams 220 sized or otherwise operable to hold the coiled tubing 142 in position and pipe rams 222 sized or otherwise operable to seal on the coiled tubing 142 being held in position by the slip rams 220. Although the BOP stack 201 is shown comprising six rams, the BOP stack 201 may be provided as two or more BOP stacks, each comprising two or more rams, connected together by a flow cross or another connector. For example, the rams 212, 214, 216, 218 may be provided at part of one BOP stack and the rams 220, 222 may be provided as part of another BOP stack.

However, instead of providing the BOP stack 201 with separate pipe rams 218, 222 and slip rams 216, 220, a BOP stack 202 may be provided comprising combination pipe/slip rams 224, 226 operable to both hold and seal against the tool string 242 or the coiled tubing 142. Accordingly, the BOP stack 201 may comprise blind rams 212, shear rams 214, a set of pipe/slip rams 224 operable to both hold and seal against the downhole tools 240 or tool string 242 extending through the BOP stack 202, and a set of pipe/slip rams 226 operable to both hold and seal against the coiled tubing 142 extending through the BOP stack 202.

Furthermore, instead of providing the BOP stack 202 with sets of combination pipe/slip rams 224, 226, a BOP stack 203 may be provided comprising a set of slip rams 228 operable to hold pipes having a wide range of sizes, such as may permit a single set of slip rams 228 to hold both the tool string 242 and the coiled tubing 142. The BOP stack 203 may also comprise a set of pipe rams 230 operable seal against a wide range of pipe sizes, such as may permit a single set of pipe rams 230 to seal against both the tool string 242 and the coiled tubing 142. Accordingly, the BOP stack 203 may comprise blind rams 212, shear rams 214, a set of variable size slip rams 228 operable to hold both the tool string 242 and the coiled tubing 142 extending through the BOP stack 203, and a set of pipe rams 230 operable to seal against both the tool string 242 and the coiled tubing 142 extending through the BOP stack 203.

FIGS. 5-9 show a portion of the wellsite system 100 shown in FIG. 1 at different stages of deployment operations utilizing the deployment unit 110 in conjunction with other devices and tools. The following description refers to FIGS. 1-9, collectively.

Figure 5:
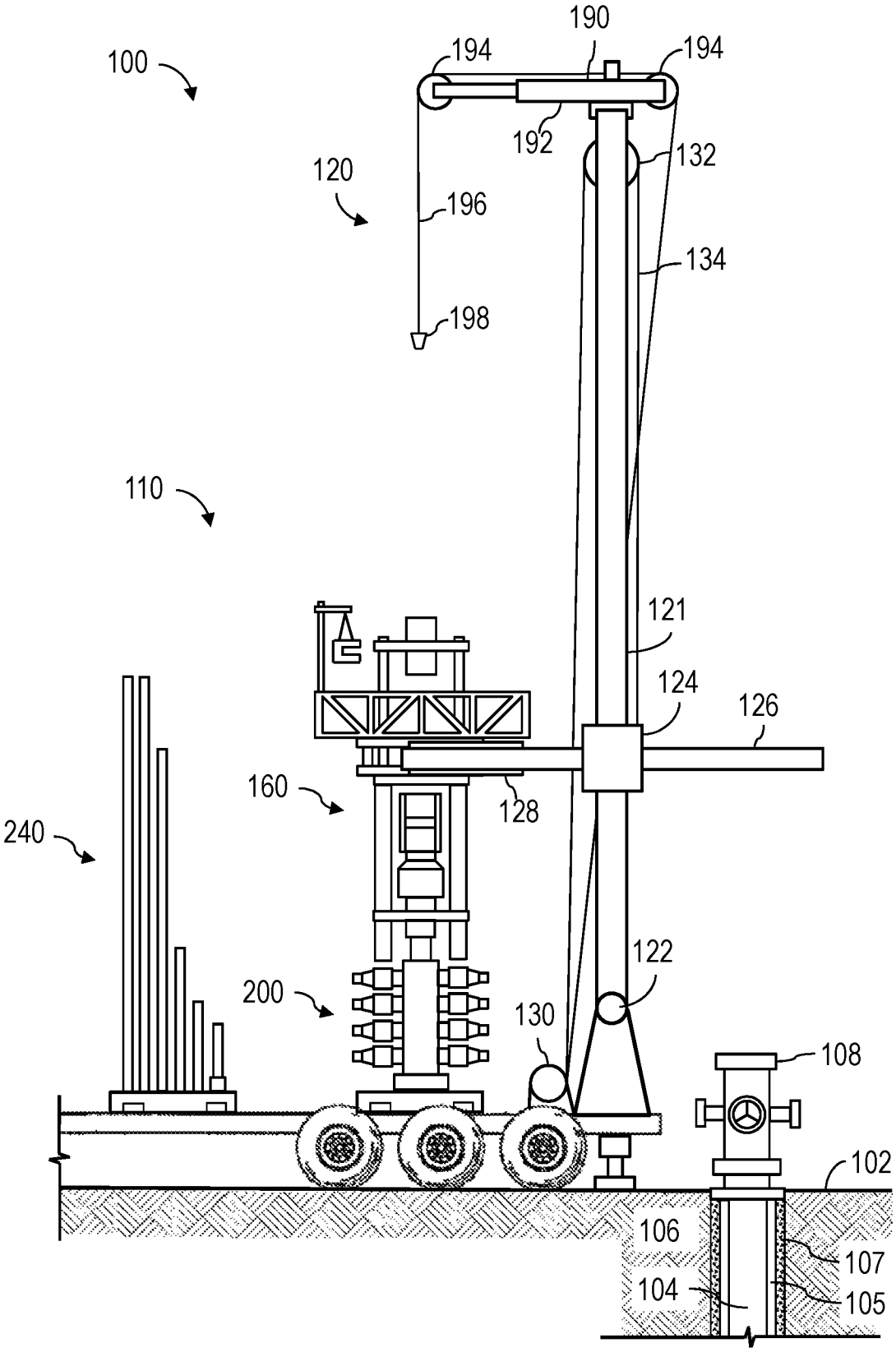
FIG. 5 is a schematic view of a portion the apparatus shown in FIG. 1 in a different stage of operation.

As shown in FIG. 5, the snubbing unit 160 may be coupled with the BOP stack 200 and positioned to permit coupling with one of the carriages 124, 128. The snubbing unit 160 may be lifted onto the BOP stack 200 by the lift system 190 or another external crane (not shown) to permit coupling with the BOP stack 200. The carriages 124, 128 may be lowered and positioned adjacent the snubbing unit 160, such as may permit the snubbing unit 160 to be coupled with one of the carriages 124, 128. The snubbing unit 160 and BOP stack 200 assembly may also be lifted and positioned adjacent to one of the carriages 124, 128 via the lift system 190 or the external crane, such as may permit the snubbing unit 160 to be coupled with one of the carriages 124, 128.

Figure 6:
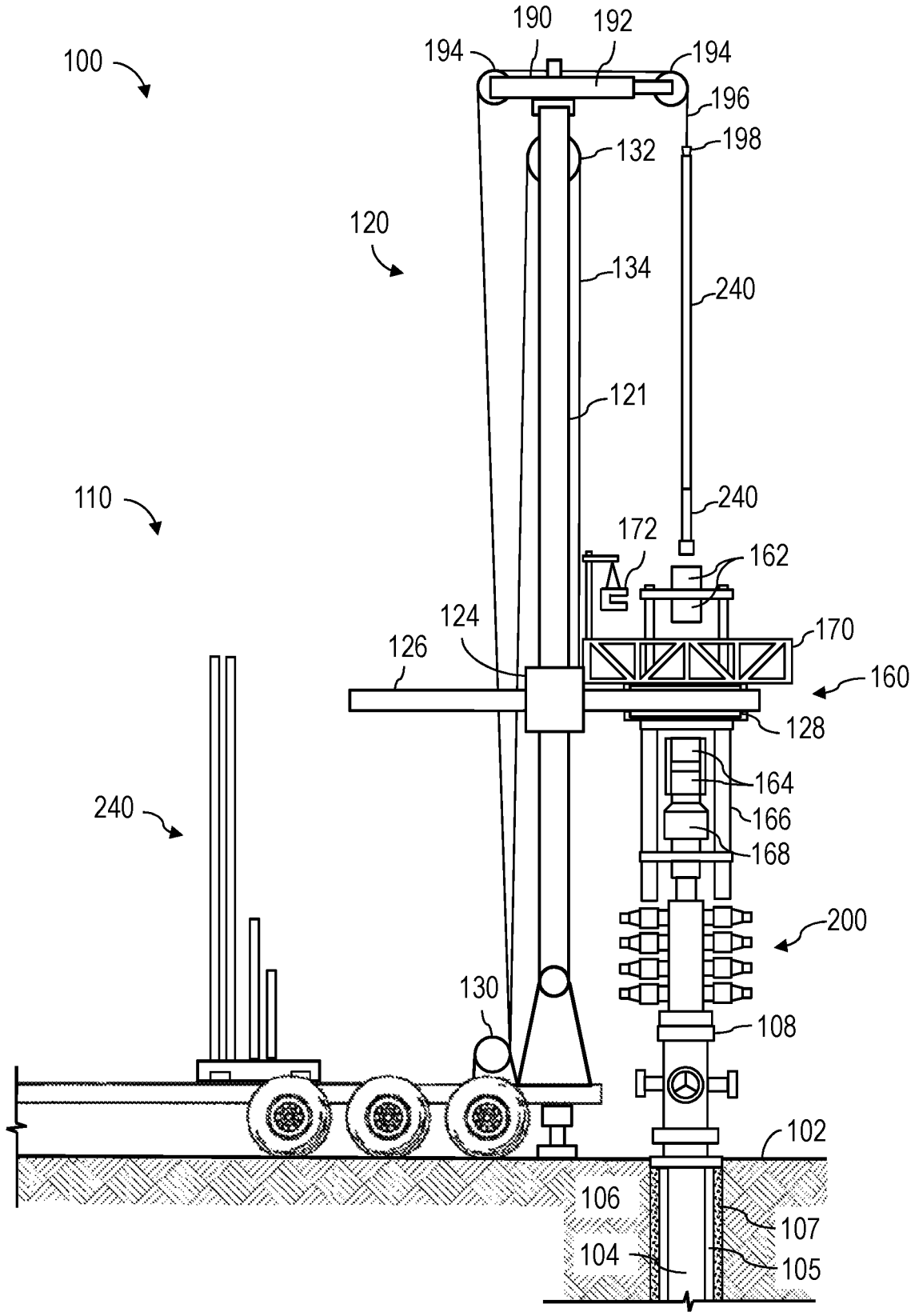
FIG. 6 is a schematic view of the apparatus shown in FIGS. 1 and 5 in a different stage of operation.

As shown in FIG. 6, once the snubbing unit 160 and the BOP stack 200 assembly is coupled with the carriage 124, 128, the snubbing unit 160 and the BOP stack 200 may be positioned over and lowered onto the wellhead 108, such as may permit the BOP stack 200 to be coupled with the wellhead 108. Although FIGS. 5 and 6 show the snubbing unit 160 and the BOP stack 200 being connected together first and then collectively moved onto the wellhead 108, however the BOP stack 200 and the snubbing unit 160 may be moved together or one at a time by the carriages 124, 128, the lift system 190, or the external crane. For example, the BOP stack 200 may be moved onto and connected with the wellhead 108 and then the snubbing unit 160 may be moved onto and connected with the BOP stack 200. Thereafter, the hydraulic jack 166 of the snubbing unit 160 and the BOP stack 200 may be fluidly connected with the hydraulic power unit 180 via fluid conduits (not shown) to provide hydraulic power to the snubbing unit 160 and the BOP stack 200. Subsequently, downhole tools 240 having a relatively short length may be made up and hoisted via the lift system 190 or the external crane above the snubbing unit 160 for deployment into the wellbore 104. The short downhole tools 240 may also be individually hoisted for individual deployment into the wellbore 104.

During the course of the snubbing operations into the wellbore 104, one or more downhole tools 240 may be positioned extending through the traveling and stationary slips 162, 164, just above the annular BOP 168. The snubbing one of the traveling slips 162 may be activated to hold the downhole tools 240 and force them into the wellbore 104 through the annular BOP 168, permitting the wellhead 108 to be opened. Once the traveling slips 162 reach bottom position, the snubbing one of the stationary slips 164 may hold the downhole tools 240 and the traveling slips 162 may disengage and return to the upper position. Such process may be repeated until an upper end of the downhole tools 240 is positioned just above or within the work basket 170.

While the downhole tools 240 are being deployed, the lift system 190 may be utilized to lift a subsequent downhole tool 240. The lift system 190 may then position the subsequent downhole tool 240 above the deployed tools 240 such that a lower joint of the subsequent tool 240 abuts an upper joint of the deployed tools 240. The torquing device 172 may then be utilized by the human operator to make up the opposing joints and, thus, couple the downhole tools 240. During the snubbing operations, the wellbore fluids may be controlled by the annular BOP 168. While the subsequent tool 240 is being coupled, the deployed tool 240 may be maintained suspended or otherwise in position within the wellbore 104 via the stationary slips 164. However, depending on the type of BOP stack 200 utilized, the deployed downhole tools 240 may also be held in position by the slip rams 216, the combination pipe/slip rams 224, or the variable sized slip rams 228.

Once the downhole tools 240 are made up, the traveling slips 162 may engage the subsequent downhole tool 240 and the traveling slips 164 and perhaps the slip rams 216, 224, 228 may disengage from the deployed tools 240 and the snubbing process may be repeated until an upper end of the coupled downhole tools 240 is positioned just above or within the work basket 170. Additional downhole tools 240 may be ran into the wellbore 104 via substantially the same process until most of the downhole tools 240 are deployed within the wellbore 104, substantially forming the tool string 242.

By making up and deploying the tool string 242 with the snubbing unit 160 one or more downhole tools 240 at a time, as opposed to assembling an entire tool string at the wellsite surface 102 and then deploying it into the wellbore 104, the deployment unit 110 may be utilized to assemble tool strings 242 that may be substantially longer than the height of the mast assembly 120 or the maximum height to which an assembled tool string can be lifted by the mast assembly 120 above the BOP stack 200. Such method may be utilized to assemble tool strings 242 ranging between about 9.15 meters (30 feet) and about 30.50 meters (100 feet) or longer. Some downhole tools 240, such as lengths of pipe, downhole motors, directional control subs, sensor subs, among other examples, may be long pieces of downhole equipment, often ranging between about 3.05 meters (10 feet) and about 6.10 meters (20 feet) in length. Incorporating two or more of such tools in a tool string deployed by coiled tubing may be quite difficult if not impossible, as the tool string may exceed the height of the mast assembly 120. A tall mast assembly, such as one exceeding 30.50 meters (100 feet), may also not be sufficient to accommodate some tool strings. For example, an injector head may hang below a trolley or carriage of a mast assembly, causing a substantial portion of the mast height to be lost. Furthermore, wellhead and BOP assemblies often extend about 6.10 meters (20 feet) or more above a wellbore, further decreasing available distance between an injector head and the BOP stack. For example, an approximately 30.50 meter (100 feet) mast assembly may yield between about 9.14 meters (30 feet) and about 15.24 meters (50 feet) of usable distance to hang a preassembled tool string for deployment.

Figure 7:
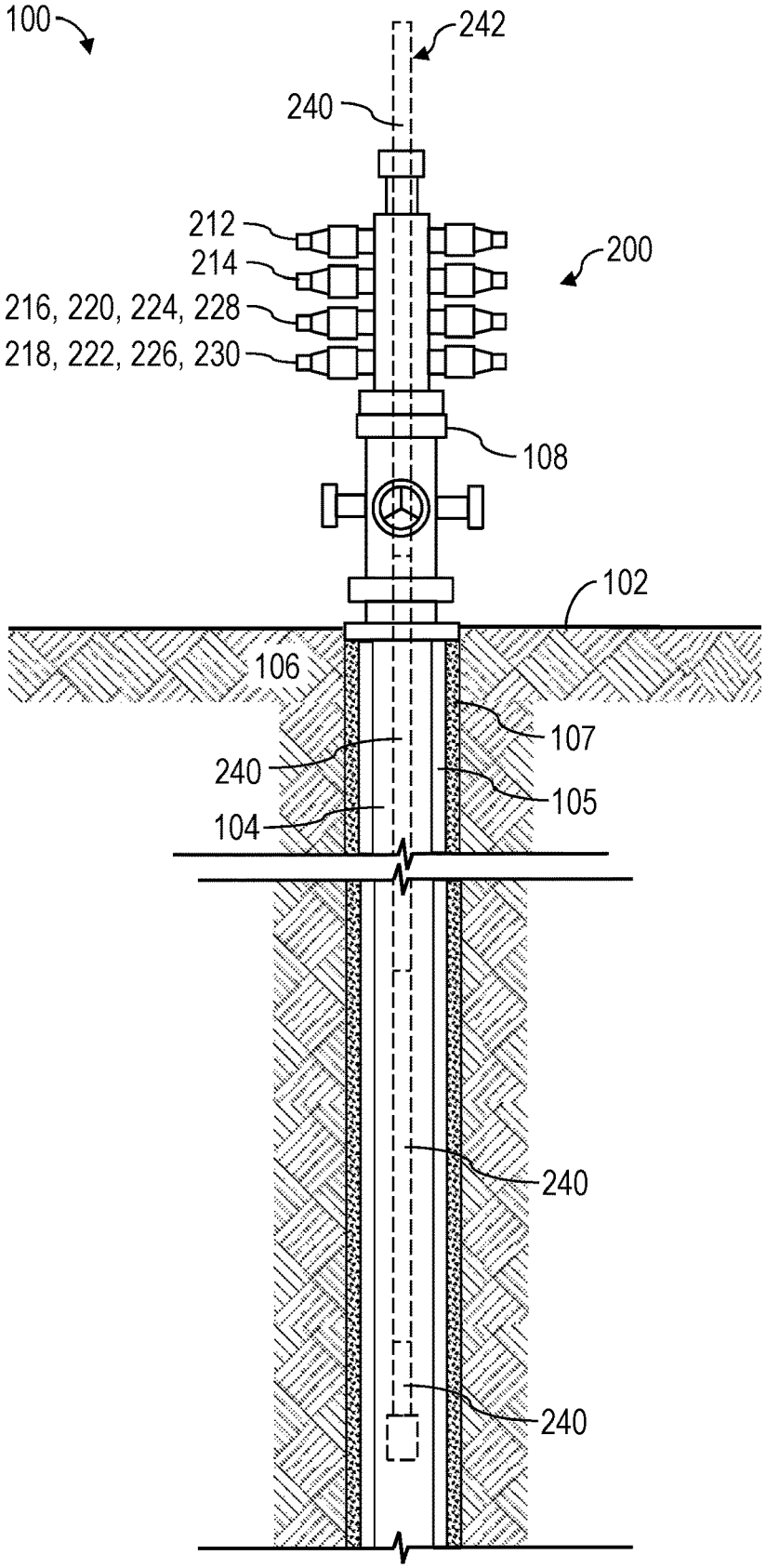
FIG. 7 is a schematic view of the apparatus shown in FIGS. 1, 5, and 6 in a different stage of operation.

Once most of the tool string 242 has been deployed within the wellbore 104, the tool string 242 may be connected with the coiled tubing 142 and deployed further into the wellbore 104 via the injector head unit 150 to perform well intervention or other intended operations. To perform such operations, the snubbing unit 160 may be disconnected and removed from the BOP stack 200 and replaced with the injector head unit 150. The snubbing unit 160 may be removed via the carriage 124, 128 or the lift system 190. Once the snubbing unit 160 is removed, an upper end of the tool string 242 may be exposed, extending from the BOP stack 200. FIG. 7 is a schematic view of a portion of the wellsite system 100, showing the snubbing unit 160 removed and the mostly assembled tool string 242 extending above the BOP stack 200 and suspended within the wellbore 104.

However, before the snubbing unit 160 can be removed and the injector head unit 150 installed, the deployed tool string 242 may be secured in position within the wellbore 104 and sealed to prevent the wellbore fluids from being discharged onto the wellsite surface 102. The tool string 242 may be held in position and sealed by the BOP stack 200. Depending on the type of BOP stack 200 utilized (e.g., BOP stacks 201, 202, 203), the tool string 242 may be held in position by the slip rams 216, the combination pipe/slip rams 224, or the variable sized slip rams 228. Similarly, depending on the type of BOP stack 200 utilized, the annulus of the wellbore 104 may be sealed by the pipe rams 218, the combination pipe/slip rams 224, or the variable sized pipe rams 230. The tool string 242 may also be maintained in position by a hanger flange (not shown) located within and BOP stack 200 or the wellhead 108.

Figure 8:
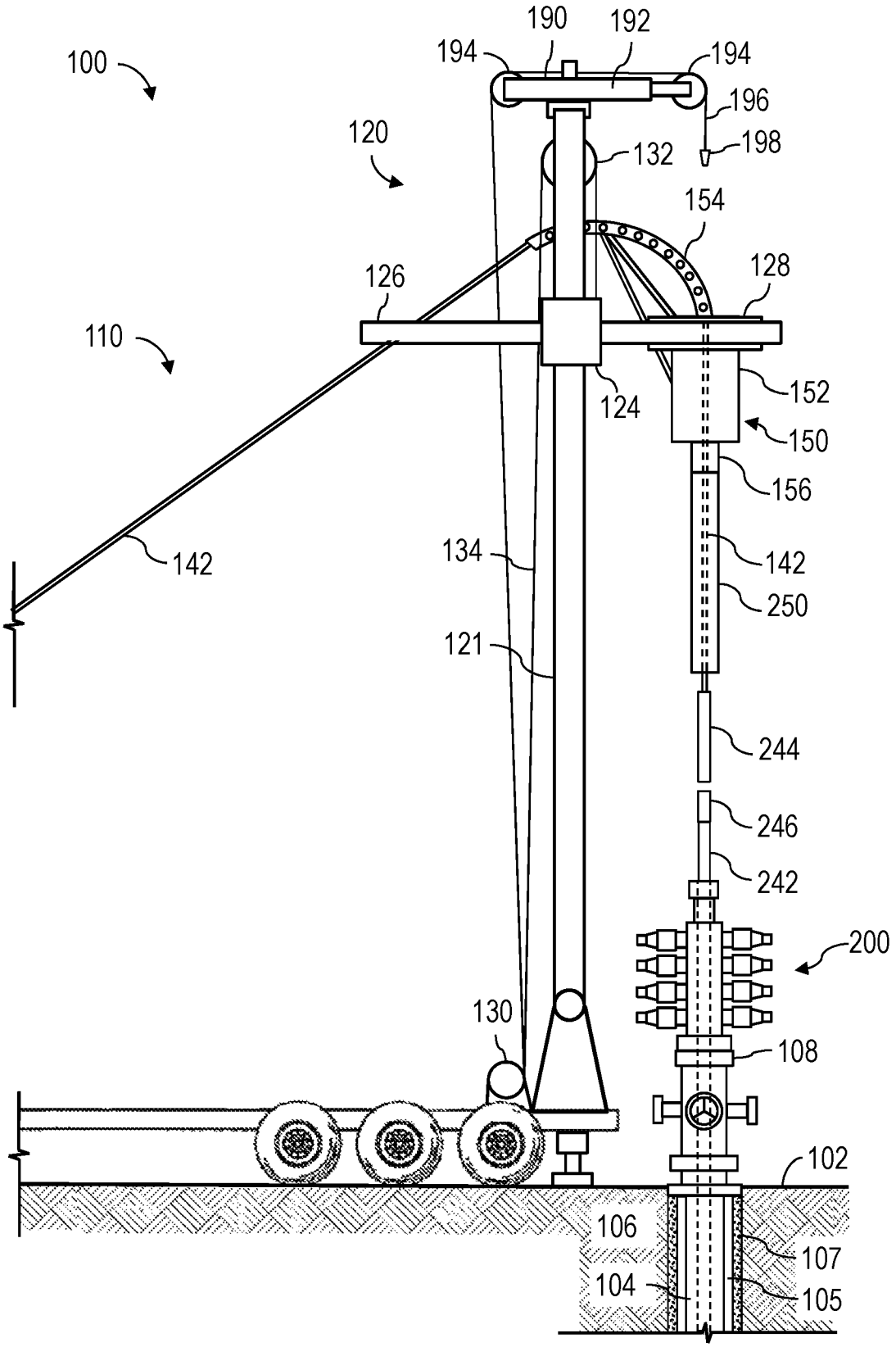
FIG. 8 is a schematic view of the apparatus shown in FIGS. 1 and 5-7 in a different stage of operation.
Figure 9:
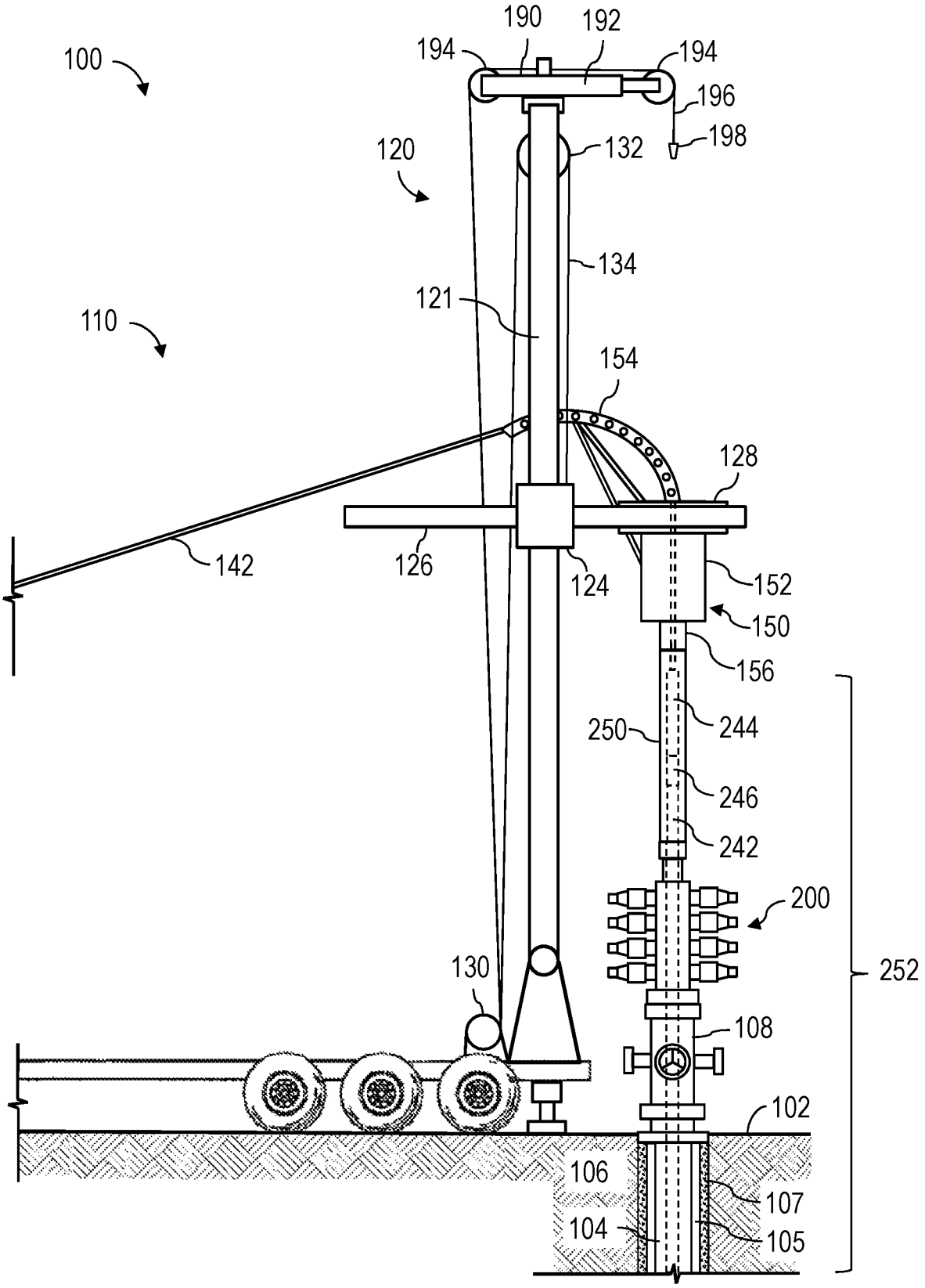
FIG. 9 is a schematic view of the apparatus shown in FIGS. 1 and 5-8 in a different stage of operation.

Once the snubbing unit 160 is disconnected from the BOP stack 200, it may be disconnected from the carriage 124, 128. Thereafter, similarly to as described above with respect to the snubbing unit 160, the injection head unit 150 may be positioned adjacent the mast assembly 120, such as may permit the injection head unit 150 to be coupled with one of the carriages 124, 128. The carriages 124, 128 may be lowered and positioned adjacent the injection head unit 150, such as may permit the injection head unit 150 to be coupled with one of the carriages 124, 128. The injection head unit 150 may also be lifted and positioned adjacent one of the carriages 124, 128 by the lift system 190, such as may permit the injection head unit 150 to be coupled with one of the carriages 124, 128. Once the injection head unit 150 is coupled with one of the carriages 124, 128, the carriage 124, 128 may lift and position the injection head unit 150 over the BOP stack 200 and the tool string 242. FIGS. 8 and 9 are a schematic views of a portion of the wellsite system 100 at different stages of operation showing the injection head unit 150 positioned above the BOP stack 200 and the tool string 242.

As shown in FIG. 8, an MHA 244 may be connected (e.g., welded) at an end of the coiled tubing 142 extending from the injection head unit 150. The MHA 244 may be connected with the coiled tubing 142 prior to the injection head unit 150 being raised. The MHA 244 may also be connected with the coiled tubing 142 offsite, prior to transporting the deployment unit 110 to the wellsite 102. The injection head unit 150 may be fluidly connected with the hydraulic power unit 180 via fluid conduits (not shown) to provide hydraulic power to the injection head unit 150. A riser 250 may be placed about the MHA 244 and/or the coiled tubing 142 extending from the injector head unit 150 and connected with the stripper assembly 156. An NRJ/swivel 246 may be threadedly or otherwise engaged with the upper end of the tool string 242 extending from the BOP stack 200. Thereafter, the carriage 124 may lower the injector head unit 150 or the injector head 152 may advance the coiled tubing 142 until the MHA 244 contacts the NRJ/swivel 246. The NRJ/swivel 246 may then be threadedly or otherwise engaged with the MHA 244 to connect the MHA 244 and the coiled tubing 142 with the tool string 242 to form a fully assembled tool string 252. Although FIG. 8 shows the NRJ/swivel 246 connected with the tool string 242 first, however the NRJ/swivel 246 may be connected with the MHA 244 first and then threadedly or otherwise engaged with the tool string 242 to connect the MHA 244 and the coiled tubing 142 with the tool string 242 to form the fully assembled tool string 252.

As shown in FIG. 9, the carriage 124 may then lower the injection head unit 150 until the riser 250 contacts the BOP 200, at which time the riser 250 may be sealingly connected with the BOP 200, such as via an NRJ, a swivel, compression, or other means. With the MHA 244 and NRJ/swivel 246 fluidly sealed within the riser 250 between the stripper assembly 156 and the pipe rams 218, 224, 230, the pipe rams 218, 224, 230 may be disengaged from the tool string 252. Because the tool string 252 is connected with and held by the coiled tubing 142, the slip rams 216, 224, 228 may now be disengaged from the tool string 252 to permit the injector head 152 to deploy the tool string 252 further into the wellbore 104 to perform the intended downhole operations, including, but not limited to drilling, milling, and patching operations.

Although the position of the tool string 252 within the wellbore 104 may be controlled by the injector head 152, the coiled tubing 142 may also be secured or held in position by the BOP stack 200 during coil string deployment or other downhole operations. Depending on the type of BOP stack 200 utilized, the coiled tubing 142 may be held in position by the slip rams 220, the combination pipe/slip rams 226, or the variable sized slip rams 228. Although the stripper assembly 156 may seal against the coiled tubing 142 to control the wellbore fluids, the BOP stack 200 may also be utilized to seal the annulus around the coiled tubing 142. Depending on the type of BOP stack 200 utilized, the annulus may be sealed by the pipe rams 222, the combination pipe/slip rams 226, or the variable sized pipe rams 230. Furthermore, although not described herein, the coiled tubing 142 and the tool string 252 may be retrieved from the wellbore 104 by implementing the methods described above in reverse order.

In view of the entirety of the present application, including the figures and the claims, a person having ordinary skill in the art will readily recognize that the present disclosure introduces an apparatus comprising a deployment unit operable at a wellsite to make up and run a downhole tool string into a wellbore, wherein the deployment unit comprises: a reel of the coiled tubing; a snubbing unit operable to run downhole tools to form the tool string; an injector head operable to run the coiled tubing with the tool string connected with the coiled tubing; and a support structure operable to support the snubbing unit and the injector head above the wellbore.

The deployment unit may be or comprise a mobile coiled tubing deployment unit.

The support structure may be or comprise a mast.

The made up downhole tool string may be substantially longer than the support structure height.

The tool string may be or comprise a bottom hole assembly.

The deployment unit may further comprise a torquing device operable to make up the downhole tools to form the tool string. The torquing device may be or comprise at least one of wrenches and tongs.

The apparatus may further comprise a BOP stack comprising: a first ram operable to hold the tool string suspended within the wellbore during deployment operations; and a second ram operable to hold the coiled tubing. The first ram may be further operable to seal on the tool string, and the second ram may be further operable to seal on the coiled tubing.

The apparatus may further comprise: a BOP stack connected above the wellbore; and a riser connectable between the injector head and the BOP stack and operable to fluidly seal a portion of the downhole tool string extending above the BOP stack, wherein the riser may be substantially shorter than length of the downhole tool string. The portion of the downhole tool string extending above the BOP stack may be or comprise at least one of a non-rotating joint, a swivel, a coiled tubing connector, and/or a motor head assembly.

The apparatus may further comprise: a BOP stack connected above the wellbore; and an annular preventer connectable between the snubbing unit and the BOP stack and operable to seal on the downhole tools as the downhole tools are run into the wellbore.

The deployment unit may further comprise a hydraulic power unit operable to provide pressurized hydraulic fluid to operate the snubbing unit and the injector head.

The deployment unit may further comprise a lift system operable to move the downhole tools from a tool storage area to the snubbing unit.

The support structure may be operable to support the snubbing unit and the injector head above the wellbore one at a time.

The present disclosure also introduces an apparatus comprising: (A) a snubbing unit operable to be supported above a wellbore by a vertical structure of a coiled tubing unit, wherein the snubbing unit is operable to run downhole tools to assemble a tool string, and wherein the snubbing unit comprises: (i) a hydraulic jack; (ii) stationary slips; and (iii) traveling slips; (B) an annular preventer; and (C) a BOP stack.

The coiled tubing unit may be or comprise a mobile coiled tubing deployment unit.

The snubbing unit may be operable to be temporarily connected to the vertical structure.

The vertical structure may be or comprise a mast.

The snubbing unit may be operable to assemble the tool string that is substantially longer than the vertical structure height. The tool string may be or comprise a bottom hole assembly.

The snubbing unit may be fluidly connectable with a hydraulic power unit of the coiled tubing unit, and the snubbing unit may be operable to be powered by the hydraulic power unit.

The snubbing unit may further comprise a torquing device operable to make up the downhole tools to assemble the tool string. The torquing device may be or comprise at least one of wrenches and tongs.

The BOP stack may be connectable with the annular preventer, and the annular preventer is connectable with the snubbing unit.

The BOP stack may comprise: a first ram operable to hold the tool string in position within the wellbore; and a second ram operable to hold the coiled tubing. The first ram may be operable to seal on the tool string, and the second ram may be operable to seal on the coiled tubing.

The BOP stack may comprise: a first ram operable to seal on the tool string; and a second ram operable to seal on the coiled tubing.

The apparatus may further comprise a riser connectable between an injector head of the coiled tubing unit and the BOP stack and operable to fluidly seal a portion of the downhole tool string extending above the BOP stack, wherein the riser may be substantially shorter than the length of the assembled tool string. The portion of the downhole tool string extending above the BOP stack may be or comprise at least one of a non-rotating joint, a swivel, a coiled tubing connector, and/or a motor head assembly.

The present disclosure also introduces a method comprising: (A) assembling a downhole tool string by: (i) making up downhole tools; and (ii) running the made up downhole tools into a wellbore with a snubbing unit; (B) connecting the downhole tool string with coiled tubing; and (C) running the coiled tubing with the connected downhole tool string with an injector head.

Running the coiled tubing and the connected downhole tool string may be performed by a coiled tubing deployment unit.

The method may further comprise positioning the snubbing unit above the wellbore, then removing the snubbing unit from above the wellbore, and then positioning an injector head above the wellbore. Positioning the snubbing unit may comprise raising the snubbing unit along a mast, and positioning the injector head may comprise raising the injector head along the mast. In such implementations, among others within the scope of the present disclosure, the method may further comprise coupling the snubbing unit to the mast before raising the snubbing unit along the mast, then uncoupling the snubbing unit from the mast, and then coupling the injector head to the mast before raising the injector head along the mast. The assembled downhole tool string may be substantially longer than the height of the mast.

The downhole tool string may be or comprise a bottom hole assembly.

Making up the downhole tools may comprise making up the downhole tools with a torquing device. The torquing device may be or comprise at least one of wrenches and tongs.

The method may further comprise fluidly sealing against the downhole tools with an annular preventer while running the made up downhole tool string into the wellbore with the snubbing unit.

The method may further comprise, while connecting the downhole tool string with the coiled tubing, holding the downhole tool string in position suspended within the wellbore with a ram of a BOP stack. The ram may be a first ram, and the method may further comprise, while connecting the downhole tool string with the coiled tubing, sealing against the downhole tool string suspended within the wellbore with the first ram or a second ram of the BOP stack.

Connecting the downhole tool string with the coiled tubing may comprise connecting the coiled tubing with the downhole tool string via at least one of a non-rotating joint, a swivel, and/or a coiled tubing connector. In such implementations, among others within the scope of the present disclosure, the method may further comprise, after connecting the downhole tool string with the coiled tubing: fluidly sealing the at least one of the non-rotating joint, the swivel, and/or the coiled tubing connector within a riser extending between a stripper assembly and a BOP stack, wherein the riser may be substantially shorter than the assembled downhole tool string length; and running the coiled tubing with the connected at least one of the non-rotating joint, the swivel, and/or the coiled tubing connector with the injector head.

The method may further comprise operating a hydraulic power unit to provide pressurized hydraulic fluid to operate the snubbing unit and injector head.

Assembling the downhole tool string may further comprise raising the downhole tools to the snubbing unit.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to permit the reader to quickly ascertain the nature of the technical disclosure. It is submitted with the understanding that it will not be used to interpret or limit the scope or meaning of the claims.

What is claimed is:

1. An apparatus comprising:

a deployment unit operable at a wellsite to make up and run a downhole tool string comprising a bottom hole assembly into a wellbore, wherein the deployment unit comprises:

a reel of the coiled tubing;

a snubbing unit operable to run downhole tools prior to completing assembly of an entire tool string;

an injector head operable to run the coiled tubing with the entire tool string connected with the coiled tubing after the snubbing unit is disconnected and moved out of the way of the injector head; and a support structure operable to support the snubbing unit and the injector head above the wellbore.

2. The apparatus of claim 1 wherein the deployment unit is or comprises a mobile coiled tubing deployment unit.

3. The apparatus of claim 1 wherein the support structure is or comprises a mast.

4. The apparatus of claim 1 wherein the made up downhole tool string is substantially longer than the support structure height.

5. The apparatus of claim 1 wherein the deployment unit further comprises a lift system operable to move the downhole tools from a tool storage area to the snubbing unit.

6. The apparatus of claim 1 wherein the support structure is operable to support the snubbing unit and the injector head above the wellbore one at a time.

7. A method comprising:

assembling a downhole tool string by:

making up downhole tools; and running the made up downhole tools into a wellbore with a snubbing unit during assembly of the downhole tool string;

connecting the downhole tool string with coiled tubing after assembly of the downhole tool string and after disconnecting and moving the snubbing unit; and running the coiled tubing with the connected downhole tool string with an injector head.

8. The method of claim 7 wherein running the coiled tubing with the connected downhole tool string is performed by a coiled tubing deployment unit.

9. The method of claim 7 further comprising positioning the snubbing unit above the wellbore, then removing the snubbing unit from above the wellbore, and then positioning an injector head above the wellbore.

10. The method of claim 9 wherein positioning the snubbing unit comprises raising the snubbing unit along a mast, and wherein positioning the injector head comprises raising the injector head along the mast.

11. The method of claim 10 further comprising:

coupling the snubbing unit to the mast before raising the snubbing unit along the mast; then uncoupling the snubbing unit from the mast; and then coupling the injector head to the mast before raising the injector head along the mast.

12. The method of claim 10 wherein the assembled downhole tool string is substantially longer than the mast height.

13. The method of claim 7 wherein the downhole tool string is or comprises a bottom hole assembly.

14. The method of claim 7 wherein making up the downhole tools comprises making up the downhole tools with a torquing device, wherein the torquing device is or comprises at least one of wrenches and tongs.

15. The method of claim 7 further comprising fluidly sealing against the downhole tools with an annular preventer while running the made up downhole tool string into the wellbore with the snubbing unit.

16. The method of claim 7 further comprising, while connecting the downhole tool string with the coiled tubing, holding the downhole tool string in position suspended within the wellbore with a ram of a blowout preventer (BOP) stack.

17. The method of claim 16 wherein the ram is a first ram, and wherein the method further comprises, while connecting the downhole tool string with the coiled tubing, sealing against the downhole tool string suspended within the wellbore with the first ram or a second ram of the BOP stack.

18. The method of claim 7 wherein connecting the downhole tool string with the coiled tubing comprises connecting the coiled tubing with the downhole tool string via at least one of a non-rotating joint, a swivel, and a coiled tubing connector.

19. The method of claim 18 further comprising, after connecting the downhole tool string with the coiled tubing:

fluidly sealing the at least one of the non-rotating joint, the swivel, and the coiled tubing connector within a riser extending between a stripper assembly and a blowout preventer (BOP) stack, wherein the riser is substantially shorter than the assembled downhole tool string length; and running the coiled tubing with the connected at least one of the non-rotating joint, the swivel, and the coiled tubing connector with the injector head.

20. The method of claim 7 further comprising operating a hydraulic power unit to provide pressurized hydraulic fluid to operate the snubbing unit and injector head.

21. The method of claim 7 wherein assembling the downhole tool string further comprises raising the downhole tools to the snubbing unit.

* * * * *